US005807094A

United States Patent [19]

Sarv

[11] Patent Number: 5,807,094

[45] Date of Patent: Sep. 15, 1998

[54] AIR PREMIXED NATURAL GAS BURNER

[75] Inventor: Hamid Sarv, Canton, Ohio

[73] Assignee: McDermott Technology, Inc., New Orleans, La.

[21] Appl. No.: 908,550

[22] Filed: Aug. 8, 1997

[51] Int. Cl.[6] ..... F23C 5/08

[52] U.S. Cl. ..... 431/177; 431/183; 431/184; 431/284; 239/404; 239/405

[58] Field of Search ..... 431/284, 174, 431/177, 183, 184; 239/403–406

[56] References Cited

U.S. PATENT DOCUMENTS

| | | | |
|---|---|---|---|
| 2,335,188 | 11/1943 | Kennedy | 431/284 |
| 2,822,864 | 2/1958 | Black | 431/284 |
| 5,240,410 | 8/1993 | Yang et al. | 431/284 |

*Primary Examiner*—Carroll B. Dority
*Attorney, Agent, or Firm*—R. J. Edwards; Eric Marich

[57] ABSTRACT

An air premixed natural gas burner having reduced thermal and prompt $NO_x$ emissions employs a central, cylindrical core chamber and an outer annular chamber separated by a hollow barrel having a plurality of gas spuds at a front end of the burner adjacent to a burner throat. The plurality of gas spuds introduces natural gas into a core chamber air flow passing through a fixed swirler and controlled by a sliding air flow damper associated with the central, cylindrical core chamber. A reduced air/fuel stoichiometric ratio (of approximately 0.6) is preferably maintained at an outlet of the central, cylindrical core chamber. The balance of the combustion air is provided through the outer annular chamber to maintain an overall or cumulative burner stoichiometric ratio of approximately 1.05.

6 Claims, 4 Drawing Sheets

AIR PREMIXED NATURAL GAS BURNER

FIELD AND BACKGROUND OF THE INVENTION

The present invention relates generally to the field of natural gas burners used in utility and industrial furnaces and, in particular, to a new and useful natural gas burner which produces reduced $NO_x$ emissions.

Control of nitrogen oxide ($NO_x$) emissions is important in the operation of natural gas burners for industrial and utility power steam generators. For many years, attempts to control $NO_x$ emissions have focused primarily upon reducing the "thermal $NO_x$" fraction formed during the oxidation of molecular nitrogen ($N_2$) at high temperatures. However, thermal $NO_x$ is only a portion of the total $NO_x$ emissions generated by natural gas combustion.

For premixed natural gas flames, burner flame peak temperatures and, consequently, thermal $NO_x$ emissions are reduced at stoichiometric air/fuel ratios below 1.0 (fuel-rich environment) and above 1.0 (fuel-lean environment). Peak flame temperatures and thermal $NO_x$ emissions are obtained when the combustion conditions are at or near a stoichiometric ratio=1.0. Reducing the stoichiometric ratio below 1.0 reduces thermal $NO_x$ but this is not an entirely effective solution since the resulting incomplete combustion generates greater amounts of carbon monoxide (CO). Similarly, operating natural gas burners at high excess air levels (stoichiometric ratio>1.20) also reduces flame temperature and $NO_x$, but this is also undesirable since fan power requirements to provide these higher excess air levels quickly increase the operating cost to unacceptable levels.

Flue gas recirculation methods and use of novel fuel gas injection elements are also known for preventing high temperature stoichiometric combustion, and thereby reducing formation of thermal $NO_x$.

However, another portion of the total $NO_x$ emissions is known as "prompt $NO_x$". Prompt $NO_x$ is generated by oxidation of cyanic compounds, such as HCN and CN, which form under fuel-rich conditions by reactions between hydrocarbon radicals with molecular nitrogen. Reducing the prompt $NO_x$ formation will reduce the overall $NO_x$ emissions from a natural gas burner.

Unfortunately, most known measures for reducing prompt $NO_x$, such as by improving the air/fuel premixing and increasing oxygen availability in the burner, can also raise the combustion temperature, and thereby increase the formation of thermal $NO_x$.

Some burners are known which incorporate air/fuel premixing in low-$NO_x$, natural gas burners. A burner made by COEN Company, Inc. has multiple radial gas spuds for uniformly introducing natural gas into the burner throat region. See, for example, U.S. Pat. No. 4,303,386, which discloses radially disposed gas spuds in an annular airflow within the burner upstream of a burner throat. John Zink, under license from Holman Boiler Works, Inc., also sells what is referred to as a CMR boiler burner, which employs Controlled Mix Recirculation of flue gas together with Fuel-Induced Recirculation (FIR) to reduce $NO_x$.

A burner having natural gas injected at a point between the swirler blades for rapid mixing is sold by Radian Corporation and its licensee, Todd Combustion, under the name RAPID MIX BURNER. A combination watertube/firetube boiler sold under the name TurboFire® XL by Donlee Technologies, Inc. uses cyclonic injection and mixing of natural gas with air to reduce $NO_x$ emissions.

SUMMARY OF THE INVENTION

It is an object of the present invention to provide a natural gas burner having reduced thermal and prompt $NO_x$ emissions. Accordingly, one aspect of the present invention is drawn to a natural gas burner having reduced $NO_x$ emissions. The burner comprises a burner quarl which defines a burner throat at a front end of the burner, and a natural gas supply manifold at a back end of the burner. A double-walled, hollow cylindrical barrel is provided which terminates at the front end of the burner in an outwardly opening, frustoconical-shaped, blunt end. The barrel defines an enclosed annular chamber within inside and outside walls thereof, the inside wall defining a central, cylindrical core chamber within the barrel for conveying combustion air therethrough. A cylindrical baffle wall surrounds the front end portion of the burner and extends longitudinally from the burner quarl towards the back end of the burner. Together, the cylindrical baffle wall and the outside wall of the barrel define an annular outer chamber for conveying combustion air therethrough. Swirler means are located within the central, cylindrical core chamber adjacent to the front end of the burner for causing the combustion air conveyed therethrough to swirl and spin. Means for providing natural gas from the natural gas supply manifold to the barrel are also included, and the natural gas exits from a first plurality of radially oriented gas spuds arranged and spaced around an inner circumference of the outwardly opening, frustoconical shaped end of the barrel and immediately downstream of the swirler means, for providing natural gas into the central, cylindrical core chamber. Finally, means are included for providing combustion air to the central, cylindrical core chamber and the annular outer chamber.

Accordingly, a gas burner is disclosed which can be operated to reduce thermal and prompt $NO_x$ emissions having a front end open to a combustion region, a back end, and a cylindrical casing. The double-walled, hollow cylindrical barrel divides the burner into two chambers: an inner, central cylindrical core chamber and an annular outer chamber. Combustion air is provided to a windbox which surrounds the annular outer chamber, and which is subdivided by a horizontal cylindrical baffle wall. Combustion air can pass from the windbox into the annular outer chamber, where a plurality of adjustable spin vanes are provided adjacent to a burner throat end of the annular outer chamber.

A stationary swirler is positioned at the end of an elongated fixed guide pipe on the longitudinal axis of the central, cylindrical core chamber. A sliding core air control damper is oriented adjacent to the back end of the burner, on a cylindrical barrel extension. Slots through the cylindrical barrel extension at the back end thereof allow a portion of the combustion air to pass from the windbox into the central, cylindrical core chamber. The sliding core air control damper selectively controls the amount of combustion air allowed through the central, cylindrical core chamber.

A natural gas supply manifold is positioned adjacent to the back end of the burner and provides natural gas fuel into the annular space defined between the double walls of the hollow cylindrical barrel to a plurality of (preferably) multiple-hole gas spuds. In a first embodiment, the gas spuds are positioned only around the inner wall of the barrel at the throat end downstream of the fixed swirler. A second plurality of gas spuds can be located on the outer wall of the hollow cylindrical barrel immediately downstream of the spin vanes.

In a second embodiment, the natural gas supply manifold supplies natural gas to a torus-shaped natural gas supply manifold adjacent to the throat end of the burner and surrounding the end of the annular outer chamber. A third plurality of gas spuds can provide natural gas from the torus-shaped natural gas supply manifold through the cylindrical baffle wall into the annular outer chamber at a location immediately downstream of the adjustable spin vanes.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
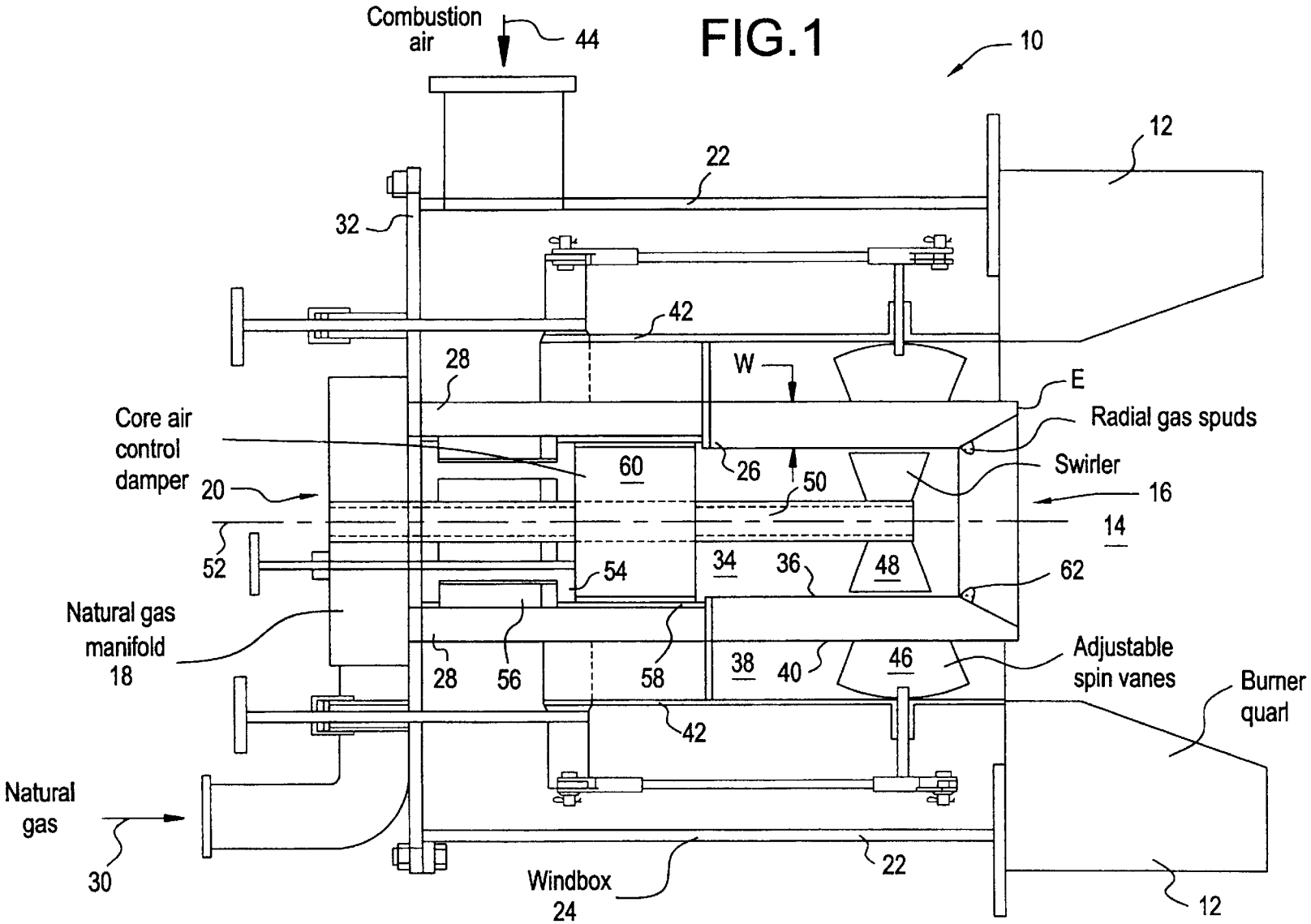
FIG. 1 is a sectional side elevational view of a first embodiment of a burner according to the present invention.
Figure 2:
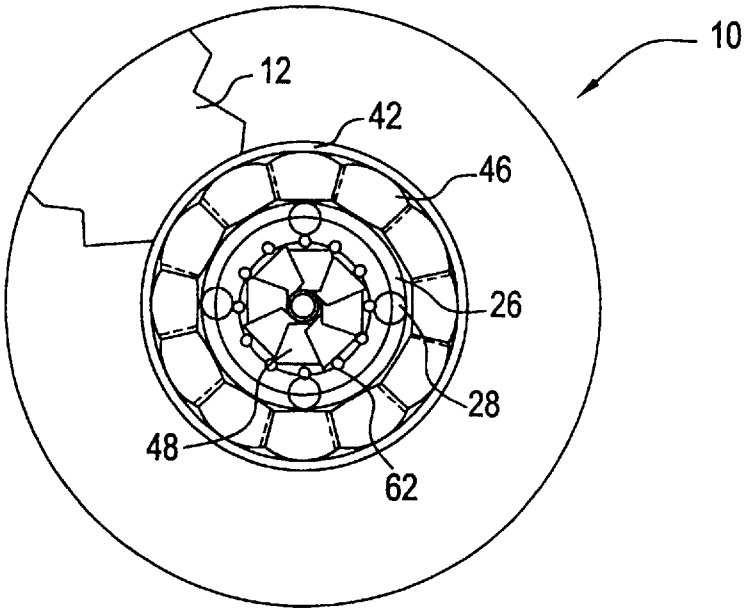
FIG. 2 is a front elevational view, partly in section, of the burner shown in FIG. 1.

Referring to the drawings, wherein like reference numerals designate the same or functionally similar elements throughout the several drawings, FIGS. 1 and 2 show a burner 10 having a burner quart 12 which defines a burner throat 14 at a front end 16 of the burner 10. A natural gas supply manifold 18 is provided at a back end 20 of the burner 10. An outer burner wall 22 of burner 10 encloses windbox 24. A double-walled, hollow cylindrical barrel 26 which defines an enclosed annular chamber of width W between its double (inner and outer) walls is provided within the burner 10 and is used to convey natural gas for combustion to the front end of the burner 10. The barrel 26 terminates at the front end 16 of the burner 10 in an outwardly opening, frustoconical-shaped, blunt end E to create a "recirculation zone" between two air flow regions (described infra) to enhance flame attachment to the front end 16 of barrel 26. One or more cylindrical gas supply conduits 28, preferably four in number, are in fluidic communication with and extend from the natural gas supply manifold 18 to a back end of the hollow cylindrical barrel 26 to provide natural gas 30 from a source (not shown) to the hollow cylindrical barrel 26. The conduits 28 extend through a back wall 32 at the back end 20 of the burner 10 from the natural gas supply manifold 18 to the barrel 26 which, in turn, extends to the burner throat 14 at the front end 16. The hollow cylindrical barrel 26 divides the front end 16 of the burner 10 into two primary chambers—a central, cylindrical core chamber 34 within an inside wall 36 of hollow cylindrical barrel 26, and an annular outer chamber 38 defined by an outside wall 40 of hollow cylindrical barrel 26 and a cylindrical baffle wall 42 surrounding the front end portion 16 of burner 10. The width W is selected so that the front end of the barrel 26 can outwardly open with a sufficiently wide, frustoconical-shaped, blunt end E, thereby separating the central, cylindrical core chamber 34 from the annular outer chamber 38 and creating the aforementioned "recirculation zone" for flame attachment.

The cylindrical baffle wall 42 extends from the front end 16 of the burner 10 towards the back end 20, and stops short of the back wall 32. Baffle wall 42 thus partially subdivides the windbox 24 region between outside wall 40 and outer burner wall 22 to create the annular outer chamber 38. Combustion air 44 from a source (also not shown) is provided to the windbox 24. A first portion of the combustion air 44 passes around cylindrical baffle wall 42 and into the annular outer chamber 38. Adjustable spin vanes 46 are positioned at the front end 16 of the annular outer chamber 38 in between cylindrical baffle wall 42 and the outside wall 40 of the hollow cylindrical barrel 26 to direct and control the first portion of the combustion air 44 flowing through the annular outer chamber 38 into the burner throat 14.

Within the central cylindrical core chamber 34, a swirler 48 is mounted on a guide pipe 50 which is oriented and extends along a central longitudinal axis of symmetry 52 of the burner 10. Guide pipe 50 extends through the back wall 32 of the burner 10 and beyond natural gas supply manifold 18. The guide pipe 50 and its attached swirler 48 do not rotate, but the swirler 48 imparts a spin to a second portion of the incoming combustion air 44 passing through the central, cylindrical core chamber 34. If desired, the guide pipe 50 may be hollow and open to allow for insertion of an ignitor means or an auxiliary light or residual fuel oil nozzle therealong to the front end 16 of the burner 10. Alternatively, an ignitor can be installed through other burner penetrations (not shown). A cylindrical barrel extension 54 having a plurality of longitudinal slots 56 is provided at the back end 20 of the burner 10, extending from back wall 32 to a rear portion 58 of the barrel 26. The plurality of longitudinal slots 56 are located on the end of the cylindrical barrel extension 54 adjacent to the back wall 32, and spaced around a circumference of the cylindrical barrel extension 54. The second portion of the combustion air 44 from the windbox 24 passes through slots 56 into the central, cylindrical core chamber 34. A sliding core air control damper 60 is positioned adjacent to the cylindrical barrel extension 54 to cover or uncover the longitudinal slots 56 and thereby control the amount of combustion air 44 conveyed through the central, cylindrical core chamber 34 past swirler 48 and, subsequently, into the burner throat 14.

In the first embodiment of FIGS. 1 and 2, natural gas exits from the front end 16 of the barrel 26 through a first plurality of radially oriented, preferably multiple-hole gas spuds 62. This first plurality of gas spuds 62 are arranged and spaced around an inner circumference of the outwardly opening, frustoconical-shaped end of the barrel 26, and immediately downstream of the swirler 48. This reduces the potential for flame flashback into the central, cylindrical core chamber 34.

In addition to the first plurality of gas spuds 62, a second plurality of radially oriented, preferably multiple-hole gas spuds 64 can also be provided on the outer wall 40 of the barrel 26 immediately downstream of the adjustable spin vanes 46. While this second plurality of gas spuds 64 is shown in FIGS. 3 and 4, described infra, it will be understood that this second plurality of gas spuds 64 does not require the embodiment of FIGS. 3 and 4 for them to be used.

Figure 3:
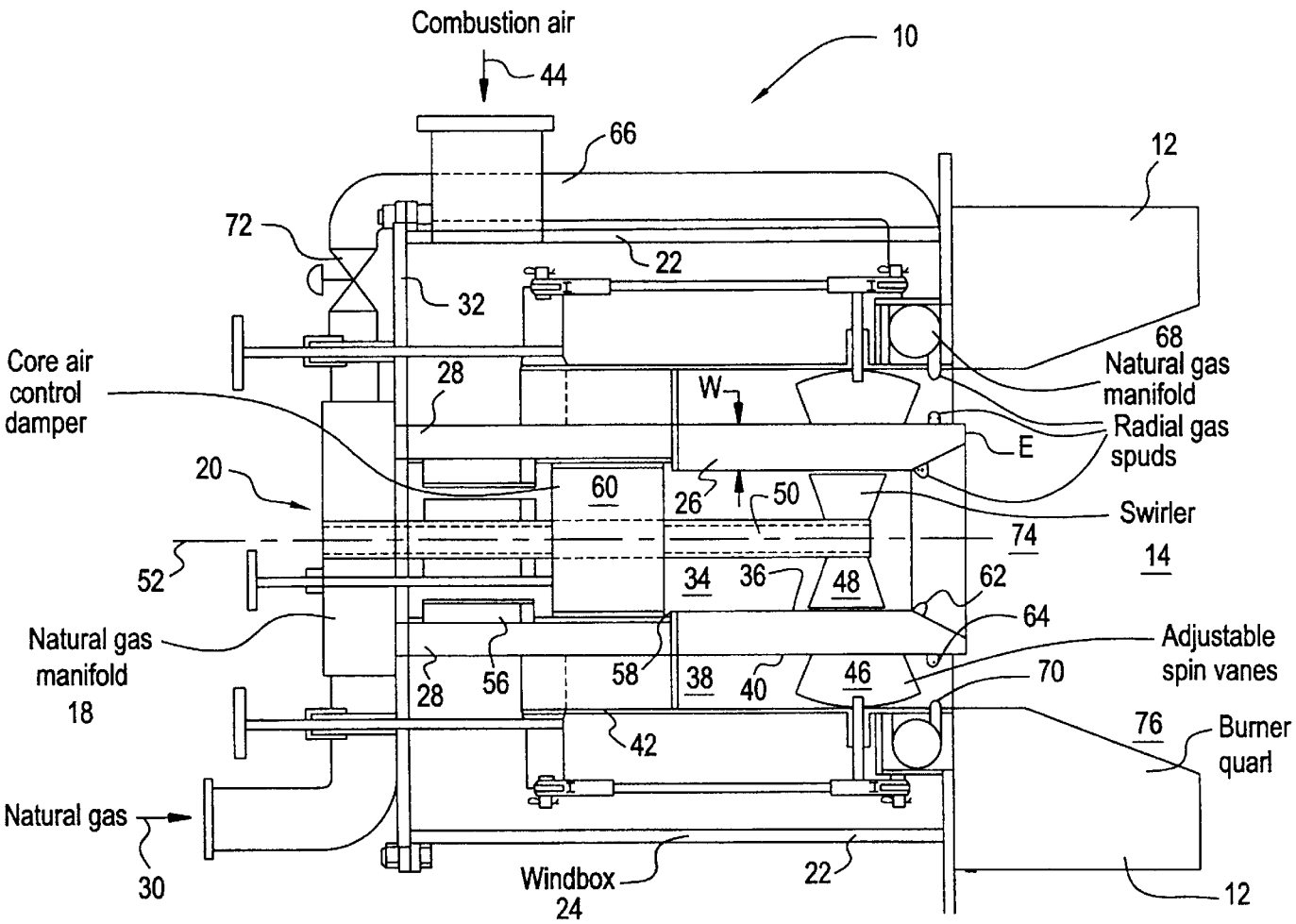
FIG. 3 is a sectional side elevational view of a second embodiment of a burner according to the present invention.
Figure 4:
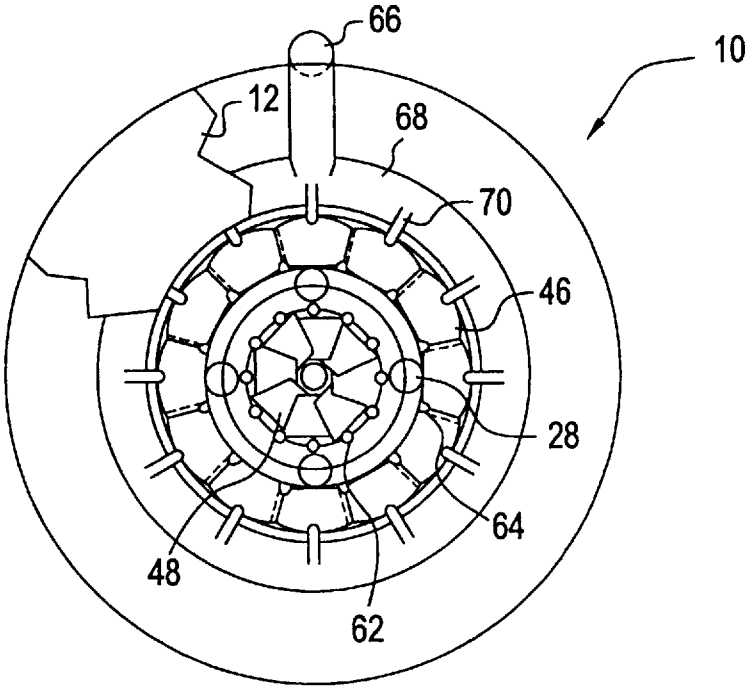
FIG. 4 is a front elevational view, partly in section, of the burner shown in FIG. 3.

In a second embodiment of the invention, shown in FIGS. 3 and 4, an auxiliary gas supply pipe 66 extends upwardly from the main natural gas supply manifold 18 and across the top of burner 10 to a torus-shaped natural gas supply manifold 68 which circumferentially surrounds the cylindrical baffle wall 42 at the front end 16 of burner 10. A third plurality of radially oriented, preferably multiple-hole gas spuds 70 projects from this torus-shaped gas supply manifold 68 through the cylindrical baffle wall 42. This third plurality of gas spuds 70 is also located immediately downstream of the adjustable spin vanes 46, but it is opposite the second plurality of gas spuds 64 on the outside wall 40 of barrel 26. A manually or automatically controlled gas valve 72 can be used to control the amount of natural gas 30 diverted from the main natural gas supply manifold 18 to the torus-shaped natural gas supply manifold 68.

In operation, the sliding core air control damper 60 and gas valve 72 are controlled to cause the fuel and air mixture adjacent to the outlet of central, cylindrical core chamber 34, and in a central combustion zone 74 downstream of the barrel 26 but within the burner throat 14, to be sub-stoichiometric, and preferably equal to or less than 0.6 stoichiometric ratio (fuel rich). The stoichiometric ratio provided at an outlet of the outer annular chamber 38, and in an outer annular combustion zone 72 downstream of the burner 10 but within the burner throat 14, should be preferably equal to or greater than 2.5 (fuel-lean). Operation at these levels will result in reduced thermal and prompt $NO_x$ emissions, but not the absolute minimum possible with the burner 10. A shorter burner flame can also be obtained by adjusting these stoichiometric operational parameters. It will be noted that while the direction of spin imparted to the combustion air 44 flowing past the swirler 48 and adjustable spin vanes 46 can be in the same or opposite directions, it is preferred that they be in opposite directions; i.e., one clockwise and the other counter-clockwise. This combination of opposite spinning air flow exiting from the burner 10 further enhances creation of the "recirculation zone" at the blunt end E at the outlet of the barrel 26, enhancing flame attachment.

Numerical modeling studies of the air premixed natural gas burner according to the present invention indicate that the lowest $NO_x$ emissions can be obtained by using only the first plurality of gas spuds 62. In this case the auxiliary gas pipe 66, the torus-shaped natural gas supply manifold 68, the third plurality of gas spuds 70, and the gas valve 72 would not be used.

To achieve the lowest $NO_x$ emissions, natural gas 30 is injected only through the first plurality of gas spuds 62 positioned downstream of the swirler 48, where it mixes with combustion air 44 passing through the swirler 48. The sliding core air control damper 60 is adjusted to achieve a sub-stoichiometric mixture (preferably at a stoichiometric ratio of 0.6 or less) of combustion air 44 and natural gas 30 exiting from the central, cylindrical core chamber 34. The fixed swirler 48 creates a low velocity zone which recirculates heat and combustion products, including $NO_x$, back to the flame root established at or near the frustoconical shaped end of the barrel 26. This sustains ignition and reduces $NO_x$ production from burner 10. The balance of the combustion air is provided through the annular outer chamber 38, and a cumulative or overall burner stoichiometry of approximately 1.05 is maintained. The diverging end of the barrel 26 expands this mixed flow outwardly into the burner throat 14, and the burner flame is stabilized by the surrounding burner quart 12.

While a specific embodiment of the invention has been shown and described in detail to illustrate the application of the principles of the invention, it will be understood that the invention may be embodied otherwise without departing from such principles.

We claim:

1. A natural gas burner having reduced $NO_x$ emissions, comprising:

a burner quarl which defines a burner throat at a front end of the burner and a natural gas supply manifold at a back end of the burner;

a double-walled, hollow cylindrical barrel which terminates at the front end of the burner in an outwardly opening, frustoconical-shaped, blunt end, the barrel defining an enclosed annular chamber within inside and outside walls thereof, the inside wall defining a central, cylindrical core chamber within the barrel for conveying combustion air therethrough;

a cylindrical baffle wall surrounding the front end portion of the burner and extending longitudinally from the burner quarl towards the back end of the burner, the cylindrical baffle wall and the outside wall of the barrel defining an annular outer chamber for conveying combustion air therethrough;

swirler means located within the central cylindrical core chamber for causing the combustion air conveyed therethrough to swirl and spin adjacent to the front end of the burner;

means for providing natural gas from the natural gas supply manifold to the barrel;

a first plurality of radially oriented gas spuds arranged and spaced around an inner circumference of the outwardly opening, frustoconical shaped end of the barrel and immediately downstream of the swirler means, for providing natural gas into the central, cylindrical core chamber; and means for providing the combustion air to the central, cylindrical core chamber and the annular outer chamber.

2. The natural gas burner according to claim 1, further comprising a plurality of adjustable spin vanes located within the annular outer chamber.

3. The natural gas burner according to claim 2, further comprising a second plurality of radially oriented gas spuds provided on the outer wall of the barrel and immediately downstream of the adjustable spin vanes, for providing natural gas into the annular outer chamber.

4. The natural gas burner according to claim 1, further comprising a torus-shaped natural gas supply manifold which circumferentially surrounds the cylindrical baffle wall, means for providing natural gas from the natural gas supply manifold at the back end of the burner to the torus-shaped natural gas supply manifold, and a third plurality of radially oriented gas spuds projecting from the torus-shaped natural gas supply manifold into the annular outer chamber and downstream of the adjustable spin vanes, for providing natural gas into the annular outer chamber.

5. The natural gas burner according to claim 4, wherein the means for providing natural gas from the natural gas supply manifold at the back end of the burner to the torus-shaped natural gas supply manifold comprises an auxiliary gas supply pipe extending from the main natural gas supply manifold and gas valve means on the auxiliary gas supply pipe to control the amount of natural gas diverted from the natural gas supply manifold to the torus-shaped natural gas supply manifold.

6. The natural gas burner according to claim 1, wherein the means for providing combustion air to the central, cylindrical core chamber and the annular outer chamber comprise a cylindrical barrel extension having a plurality of longitudinal slots spaced around a circumference of the cylindrical barrel extension and a sliding core air control damper positioned adjacent to the cylindrical barrel extension to cover or uncover the longitudinal slots and thereby control the amount of combustion air conveyed through the central, cylindrical core chamber.

* * * * *